US010899164B1

(12) United States Patent
Thibodeaux

(10) Patent No.: US 10,899,164 B1
(45) Date of Patent: Jan. 26, 2021

(54) CLIPBOARD JACKET

(71) Applicant: Christine Thibodeaux, Baton Rouge, LA (US)

(72) Inventor: Christine Thibodeaux, Baton Rouge, LA (US)

( * ) Notice: Subject to any disclaimer, the term of this patent is extended or adjusted under 35 U.S.C. 154(b) by 33 days.

(21) Appl. No.: 16/387,136

(22) Filed: Apr. 17, 2019

(51) Int. Cl.
*B42F 9/00* (2006.01)
*B43L 3/00* (2006.01)

(52) U.S. Cl.
CPC ..... *B42F 9/002* (2013.01); *B43L 3/007* (2013.01)

(58) Field of Classification Search
CPC . B43L 3/007; B42F 9/00; B42F 9/002; B65D 1/06; B41J 29/13; F24F 1/58; F24F 13/20
USPC ..... 150/154, 165, 163, 164; 206/320; 248/444.1
See application file for complete search history.

(56) References Cited

U.S. PATENT DOCUMENTS 1,967,632 A * 7/1934 Simonson ..... B43L 3/007 281/45
3,065,978 A * 11/1962 Stephens ..... B42D 5/006 281/34
4,121,637 A 10/1978 Jennings
4,963,693 A * 10/1990 Kodl ..... B43L 3/007 116/270
5,590,910 A * 1/1997 Meth ..... B42F 9/002 281/45
5,922,437 A * 7/1999 Bryant ..... B65D 65/02 150/154
7,000,660 B2 * 2/2006 Chen ..... G06F 3/0202 150/154
8,132,602 B2 * 3/2012 Sugarman ..... B43L 1/00 150/165
2001/0041088 A1 * 11/2001 Lebeau ..... G06F 3/0202 400/691
2005/0189247 A1 * 9/2005 Traugh ..... G06F 1/181 206/320
2005/0242565 A1 * 11/2005 Beno ..... B42F 9/00 281/29
2007/0029217 A1 * 2/2007 Calfas ..... B42F 9/002 206/320
2007/0119735 A1 * 5/2007 Moser ..... G06F 1/1628 206/320

* cited by examiner

*Primary Examiner* — Chun Hoi Cheung
(74) *Attorney, Agent, or Firm* — Jones Walker LLP

(57) ABSTRACT

A cover having an opening, a border, a rain screen, and a pouch, and being comprised of a flexible material and a stretchable material, wherein the cover may be used in combination with a planar rigid insert, such as a clipboard. The cover may include a strap and a handle attached to the cover.

20 Claims, 6 Drawing Sheets

CLIPBOARD JACKET

BACKGROUND OF THE DISCLOSURE

The disclosure relates to a cover in combination with a planar rigid insert, such as a clipboard.

SUMMARY OF THE DISCLOSURE

The disclosure relates to a cover having an opening, a border, a rain screen, and a pouch, and being comprised of a flexible material and a stretchable material, wherein the cover may be used in combination with a planar rigid insert, such as a clipboard.

DETAILED WRITTEN DESCRIPTION

Figure 1:
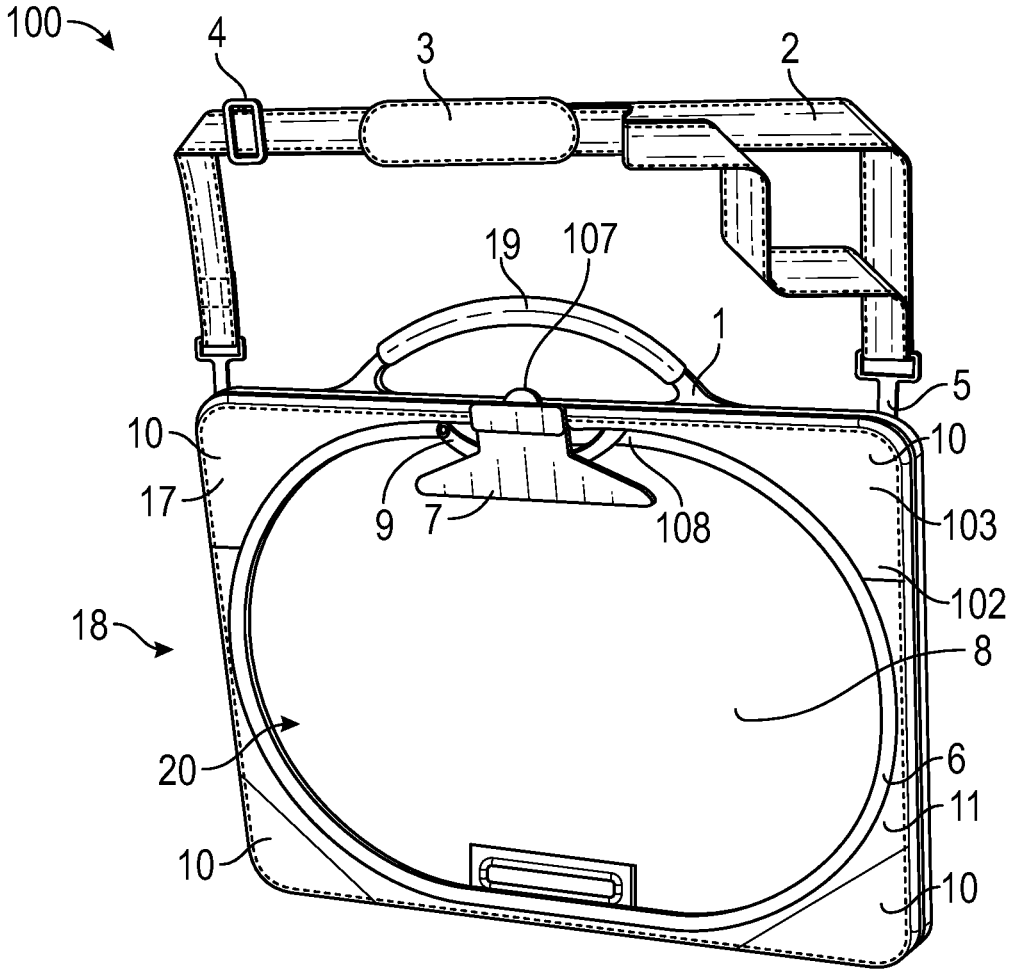
FIG. 1 is a front view of an embodiment of a cover in combination with a clipboard.
Figure 2:
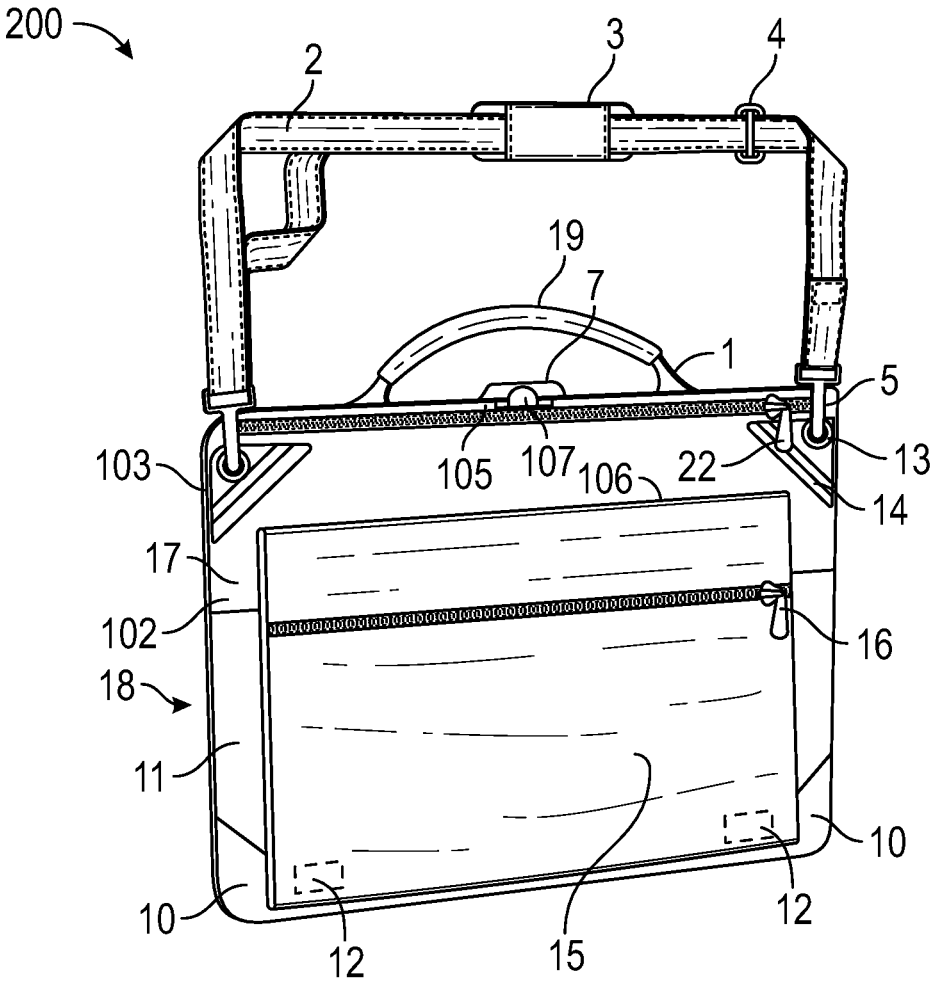
FIG. 2 is a rear view of an embodiment of a cover in combination with a clipboard having a pouch in an extended configuration.

With reference to the figures where similar elements have been given similar numerical designation to facilitate an understanding of the present disclosure, and particularly with reference to the embodiment of the cover illustrated in FIGS. 1 and 2, which illustrate a cover 18 having a pouch 15. FIG. 1 illustrates the front of cover 18 and FIG. 2 illustrates the back of cover 18. Cover 18 is designed to fit onto a planar rigid insert, such as a clipboard. Clipboards are well known within the art and generally comprise a planar rigid surface having a spring tensioned clip used to hold papers. In some embodiments, the cover 18 may be substantially rectangular in shape. In some embodiments, the clipboard 8 may be substantially rectangular in shape.

In one embodiment, cover 18 is sized to fit onto an 11"×17" clipboard. In some embodiments, cover 18 is sized to fit onto an 8½"×11" clipboard. Other embodiments of the invention may have a cover 18 sized to fit onto a clipboard having dimensions larger than 11"×17" or smaller than 8½"×11", or anywhere in between. Cover 18 may have the same approximate dimensions as the particular clipboard 8 it is designed to fit so that cover 18 will snuggly fit the clipboard 8 when positioned on it. Although not specifically illustrated, any other planar rigid insert could be used in combination with the cover 18 in accordance with aspects disclosed herein. For example, the cover 18 may be used in combination with a planar rigid insert that might not include a clip.

As shown in FIG. 1, cover 18 includes a first surface 100 having an opening 20 formed in the first surface 100. The cover 18 includes a second surface 200 (see FIG. 2) connected opposite to the first surface 100 along an edge 102 around the cover 18 to form a cavity 104 between first surface 100 and second surface 200.

In positioning cover 18 onto a clipboard 8, the clipboard 8 is inserted into opening 20 and the corners 10 of cover 18 are pulled over the corners of clipboard 8. The first surface 100 includes a border 6 that may be made of elastic material. Border 6 may form a perimeter around the opening 20 which exposes the face of the clipboard 8. In some embodiments, stretchable material 11 may be located on the first surface 100 surrounding the border 6.

The corners 10 may be made of flexible material 17. The corners 10 of cover 18 are able to be fitted over the corners of a clipboard 8 due to the expansion and contraction of the border 6 on the first surface 100 and of the stretchable material 11 included on the first surface 100 and second surface 200. Border 6 is connected to the front of cover 18 and outlines opening 20. Border 6 is any material capable of impeding cover 18 from slipping off the corners of clipboard 8. In one embodiment of the invention, border 6 is an elastic material which is capable of expanding and returning to its original shape. In some embodiments, the elastic material of the border 6 may be the same material as the stretchable material 11. In some embodiments, the elastic material of the border 6 may be a different material as the stretchable material 11.

As suggested above, border 6 may be expanded so that corners 10 of cover 18 can fit over the corners of a clipboard 8. Once the corners 10 of cover 18 are pulled over the corners of a clipboard 8, border 6 has a tendency to return to its non-stretched position. The elasticity of border 6 helps hold cover 18 onto a clipboard 8. In another embodiment of the invention, border 6 is a drawstring. In that embodiment, once cover 18 is slid over the corners 10 of clipboard 8, the drawstring is cinched tight to hold cover 18 onto clipboard 8. The corners of papers being held by a clipboard 8 may be tucked into the corners 10 of cover 18 to prevent the wind from blowing the pages.

In many embodiments, the writing surface of the clipboard 8 is exposed through opening 20 when cover 18 is positioned on the clipboard 8. In some embodiments, the opening 20 may expose at least 75% of the face or writing surface of the clipboard 8, but in other embodiments, at least any percentage between 40% and 95% of the writing surface may be exposed. Although FIG. 1 depicts opening 20 as being substantially oval shaped, opening 20 may be any shape allowing a clipboard 8 to be inserted into, and covered by, cover 18. In some embodiments, the opening 20 may have a longitudinal length substantially equal to the longitudinal length of the clipboard 8 when the clipboard 8 is disposed inside of the cavity 104 inside of the cover 18 (See FIG. 4).

Viewing FIG. 2, the second surface 200 of the cover 18 covers substantially all of one of the two sides or faces of the clipboard 8 when the clipboard 8 is fitted in the cavity 104. The second surface 200 includes flexible material 17 that covers the clipboard 8 at two lower corners 10 of the second surface 200. The second surface 200 includes flexible material 17 that covers the clipboard 8 at an upper portion of the clipboard 8. In some embodiments, the two lower corners 10 of the second surface 200 and the upper portion 103 of the second surface 200 may be made of the same flexible material 17 (e.g., canvas). In some embodiments, the two lower corners 10 of the second surface 200 may be made of a first flexible material 17 (e.g., canvas) and the upper portion 103 of the second surface 200 may be made of the a second flexible material 17 (e.g., nylon).

Figure 3:
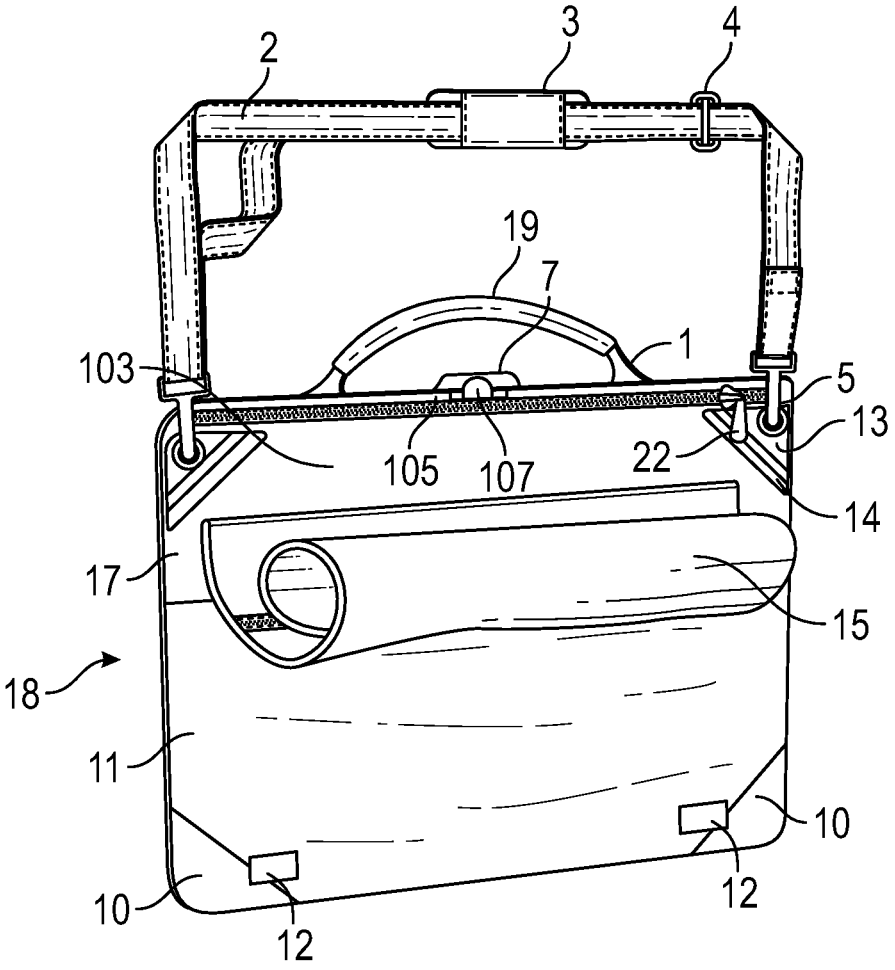
FIG. 3 is a rear view of an embodiment of a cover in combination with a clipboard having a pouch in a non-extended configuration.

As illustrated in FIGS. 1-3, a portion of cover 18 is fabricated from a flexible material 17 or combination of flexible materials 17. The second surface 200 includes stretchable material 11 that extends between the flexible material 17 of the two lower corners 100 and of the upper portion 103. In some embodiments, the stretchable material 11 on the second surface 200 may be substantially trapezoidal in shape. In some embodiments, the upper portion 103 of the second surface 200 may be substantially rectangular in shape.

A flexible material 17 is any material capable of being physically manipulated to cover a clipboard. The flexible material 17 may comprise any material; including without limitation those materials commonly used for luggage, backpacks, or tote bags such synthetic and natural blends of fabrics, canvas, nylon, polyester, leather, vinyl, and neoprene. In one embodiment, the flexible material 17 is Cordura. In some embodiments, the flexible material 17 remains substantially non-expanded and non-contracted when the clipboard 8 is inserted through the opening 20 and into the cavity 104. The seams (including edge 102) of cover 18 are bound by conventional binding techniques such as stitching.

Stretchable material 11 may be any material that is capable of expanding and contracting such as elastic, rubber, spandex fiber and lycra fiber. Incorporating stretchable material 11 into cover 18 will allow cover 18 to be expanded when pulled so that corners 10 of cover 18 can be pulled over the corners of a clipboard 8. Cover 18 may fit snugly onto a clipboard 8. To alter the snugness of the fit, the ratio of stretchable material 11 to flexible material 17 used in fabricating cover 18 can be adjusted.

The elasticity properties of the material used for stretchable material 11 may also alter how snugly cover 18 fits onto a clipboard 8. For example, the lower approximate one-half of cover 18 may be comprised of stretchable material 11 with the exception of corners 10. In some embodiments, at least about 25% of the second surface 200 is formed of stretchable material 11. In some embodiments, more or less than about 25% of the second surface 200 is formed of stretchable material 11. For example, at least about 50% of the second surface 200 may be formed of stretchable material 11. In other examples, anywhere between about 10% and about 90% of the second surface 200 may be formed of stretchable material 11.

FIG. 2 illustrates the second surface 200 of cover 18 having an attached pouch 15 extended over the second surface 200, and FIG. 3 illustrates the second surface 200 of cover 18 having the pouch 15 rolled up and exposing the second surface 200. As shown, the pouch 15 may be fixedly attached to the second surface 200 at an attachment point 106 located on the upper portion 103 of the second surface 200. For example, the pouch 15 may be stitched or sewn to the second surface 200 at attachment point 106 along the top edge of the pouch 15.

The pouch 15 may be extendable from the attachment point 106 down over the stretchable material 11 included on the second surface 200. The pouch 15 may extend toward the two lower corners 10 of the second surface 200. The pouch 15 may be closable at the top of the pouch 15 near the attachment point 106. For example, the pouch 15 may include a zipper, Velcro, tabs, snaps, flaps, and the like for opening and closing a compartment of the pouch 15.

In the embodiment illustrated in FIG. 2, pouch 15 includes zipper 16 for opening and closing a compartment of pouch 15. In some embodiments, as shown in FIG. 3, the cover 18 may include a zipper 22 at the upper part of the edge 102. Zipper 22 may be opened and closed to allow access to the cavity 104, which, in some embodiments, may contain a rain screen 21 typically positioned behind the clipboard 8.

The size, shape and design of the pouch may be varied to accommodate different needs of intended users. For example, if a particular embodiment of the invention is designed to accommodate the needs of an oil and gas surveyor, then pouch 15 may be designed to hold those instruments and equipment routinely used in such profession. In some embodiments, the pouch 15 may have a height and length that are smaller than the height and length of the second surface 200 of the cover 18. Pouch 15 may be expandable or nonexpendable. In some embodiments, the pouch 15 may include a various number and sized compartments as well as have various layouts of the compartments. Within pouch 15, there may be elastic straps specifically designed to hold certain equipment.

In some embodiments, pouch 15 may be detachably connected to cover 18 at attachment point 106 via an attachment means. Such attachment means include any method of attaching pouch 15 to cover 18, including without limitation Velcro, buckles, zippers, clasps, clips, straps, and snaps.

In some embodiments, the second surface 200 may include attachment means 12 for attaching the bottom of pouch 15 to cover 18. Attachment means includes without limitation Velcro, buttons, snaps, zippers, and the like. In one embodiment of the invention, attachments means is Velcro tabs 12, capable of being hidden behind pouch 15 (shown on FIG. 2 by dashed lines, and illustrated in FIG. 3). In the described embodiment, the underside of pouch 15 may have corresponding Velcro tabs 12 that adhere to the Velcro tabs on cover 18.

As shown in FIG. 3, stretchable material 11 continues underneath pouch 15. Other embodiments of the invention may incorporate stretchable material 11 at locations on cover 18 different from the location illustrated, and still provide sufficient expansion of cover 18 to allow the cover 18 to fit onto a clipboard 8.

FIG. 1 illustrates the cover 18 including a retainer 9 connected to the upper portion of cover 18 near an attachment point 108. Retainer 9 is a conventional strap that fits between clip front 7 and clip back 107 and snaps to cover 18. When cover 18 is lifted by handle 1, the retainer 9 prevents cover 18 from pulling away from clipboard 8 by anchoring cover 18 to clip front 7 and clip back 107. In some embodiments, the upper perimeter of the second surface 200 may include a centrally-located hole 105 that may accommodate clip back 107, such as shown in FIG. 2. Other methods of securing cover 18 to clipboard 8 may be used, such as a strap that connects one side of opening 20 to the opposite side of opening 20.

Cover 18 may include a handle 1 connected to the upper portion of cover 18. Handle 1 attaches to cover 18 using any conventional attachment means such as fastening using grommets or rivets, stitching, gluing, or binding. Handle 1 may be any shape and size capable of permitting engagement by a hand. Further, handle 1 may be comprised of any material capable of attaching to cover 18. In some embodiments, the handle 1 may be a strap. In some embodiments, the handle 1 may include equal and opposite first and second straps, where the first strap may be connected to the top of the first surface 100, and the second strap may be connected to the top of the second surface 200. In one embodiment of the invention, handle 1 will have a tubular sheath 19.

Tubular sheath 19 may be comprised of any material. For example, tubular sheath 19 may be comprised of rubber. Tubular sheath 19 may be one continuous piece of material encircling handle 1, or may in the alternative be a rectangular sheet of material that is either snapped, buttoned, velcro'd, or sewn around handle 1.

Cover 18 may include a strap 2 connected to the upper portion 103 of cover 18. Strap 2 is a conventional strap commonly used on carrying items such as luggage or tote bags. Strap 2 attaches to cover 18 using connectors 5. Connectors 5 may be any conventional means of attaching straps including without limitation rivets, grommets, clasps, and buckles. In one embodiment, strap 2 includes shoulder pad 3. In the illustrated embodiment, shoulder pad 3 is a rubber piece which is capable of conforming to the contour of a shoulder. Further, the rubber material or padded fabric used in shoulder pad 3 helps prevent strap 2 from sliding or slipping off the shoulder of someone carrying cover 18 in combination with a clipboard. Although the shoulder pad 3 in the illustrated embodiment is comprised of a rubber material, other embodiments of the invention may include a shoulder pad 3 comprised of any material commonly used with carrying straps. Alternate embodiments of the invention may include a shoulder strap located on the lower portion of cover 18 in addition to strap 2 located on the upper portion of cover 18, so that both straps may be used to carry cover 18 like a backpack. One embodiment of the invention further includes adjuster 4. Adjuster 4 is commonly used with carrying straps and is capable of being manipulated in order to adjust the length of strap 2.

In the embodiment of the invention illustrated in FIG. 2, strap 2 attaches to tabs 14. Tabs 14 may be any means permitting the attachment of strap 2 to cover 18 including without limitation loops or ears. In the embodiment illustrated in FIG. 2, tabs 14 are ears and may be comprised of any material which is suitable for the attachment of strap 2, including without limitation a flexible material 17 as referenced in connection with cover 18 above. In the embodiment illustrated in FIG. 2, tabs 14 include rings 13. Rings 13 are a reinforcement material such as brass or steel which prevent connector 5 of strap 2 from tearing the material of tabs 14.

Figure 4:
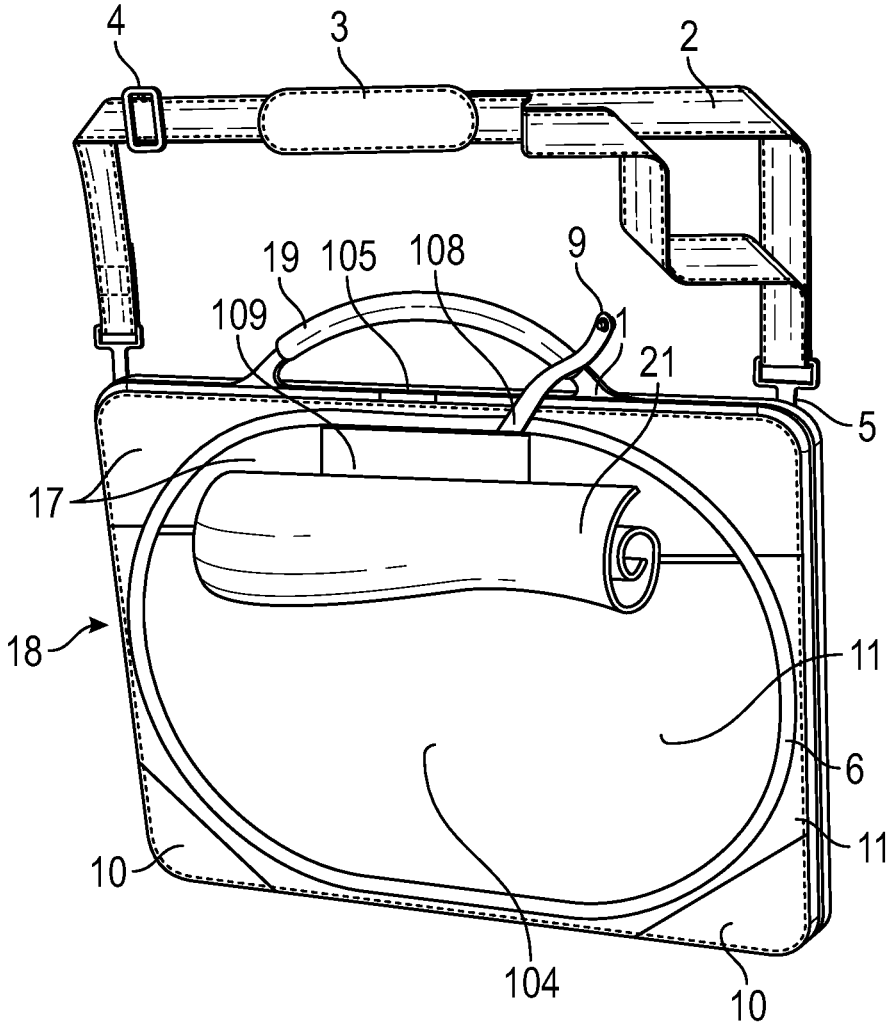
FIG. 4 is a front view of an embodiment of a cover without a clipboard having a deployable rain screen in a non-deployed configuration.
Figure 5:
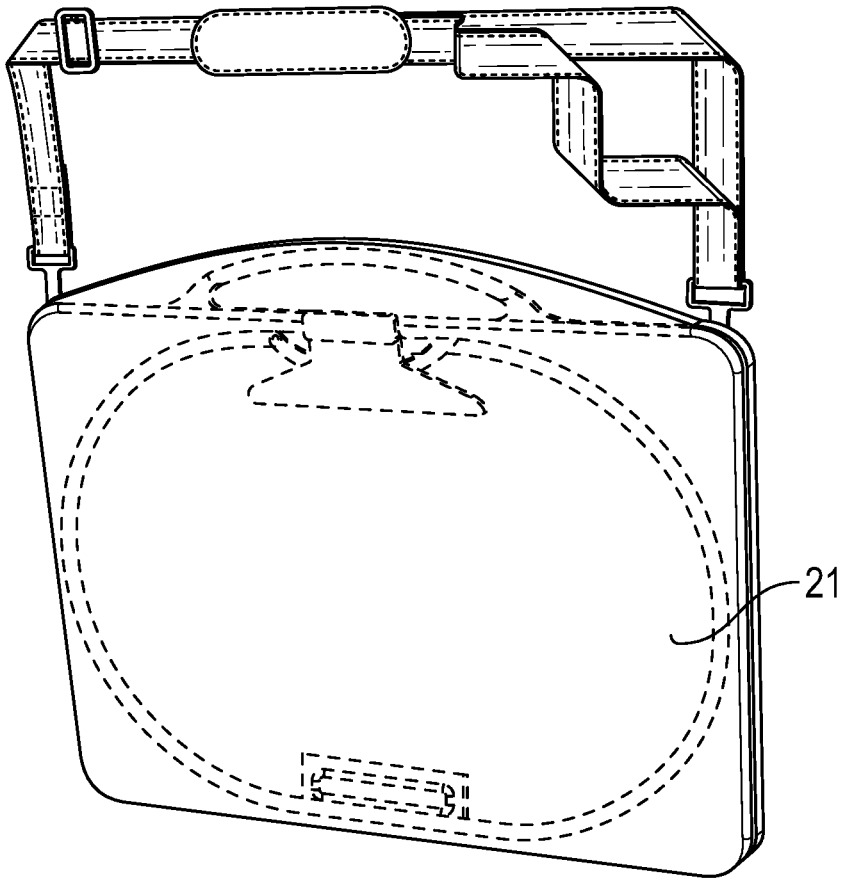
FIG. 5 is a front view of an embodiment of a cover in combination with a clipboard having a deployable rain screen in a deployed configuration.

FIG. 4 illustrates the first surface 100 of cover 18 having a deployable rain screen 21 in a non-deployed configuration, and FIG. 5 illustrates the first surface 100 of cover 18 having a deployable rain screen 21 in a deployed configuration. The rain screen 21 may be attached to the cover 18 at the attachment point 109 located at the top edge of the first surface 100. As shown, when the rain screen 21 is in a non-deployed position, the rain screen 21 may be secured in a rolled-up position. In some embodiments, when the rain screen 21 is in a non-deployed position, the rain screen 21 may be rolled-up and/or contained in a closable enclosure located at the front attachment point 109 at the top edge of the first surface 100. In some embodiments, the rain screen 21 and the closable enclosure may be formed together, such that the rain screen 21 may fold into the closable enclosure when in the non-deployed configuration.

When the rain screen 21 is in a deployed configuration, such as shown in FIG. 5, the rain screen 21 may be deployed over the opening 20 to cover the clipboard 8 by pulling over the corners 10. In some embodiments, the rain screen 21 may cover a portion of the opening 20 when deployed. In other embodiments, the rain screen 21 may cover all or substantially all of the opening 20 when deployed.

The rain screen 21 may be made of any suitable material. The rain screen 21 may be transparent or translucent, allowing a user the ability to view contents (e.g., a sheet of paper) on the face of the clipboard 8 underneath the rain screen 21. In some embodiments, the rain screen 21 may be made of waterproof material to protect the clipboard 8 and contents on the face of the clipboard 8 (e.g., a sheet of paper) from the ingress of liquid, such as rain drops or a spilt beverage. For example, the rain screen 21 may be made of plastic or nylon. In other embodiments, the rain screen 21 may be made of fabric, like satin or cotton. In some embodiments, the rain screen 21 may be made of opaque material.

Figure 6:
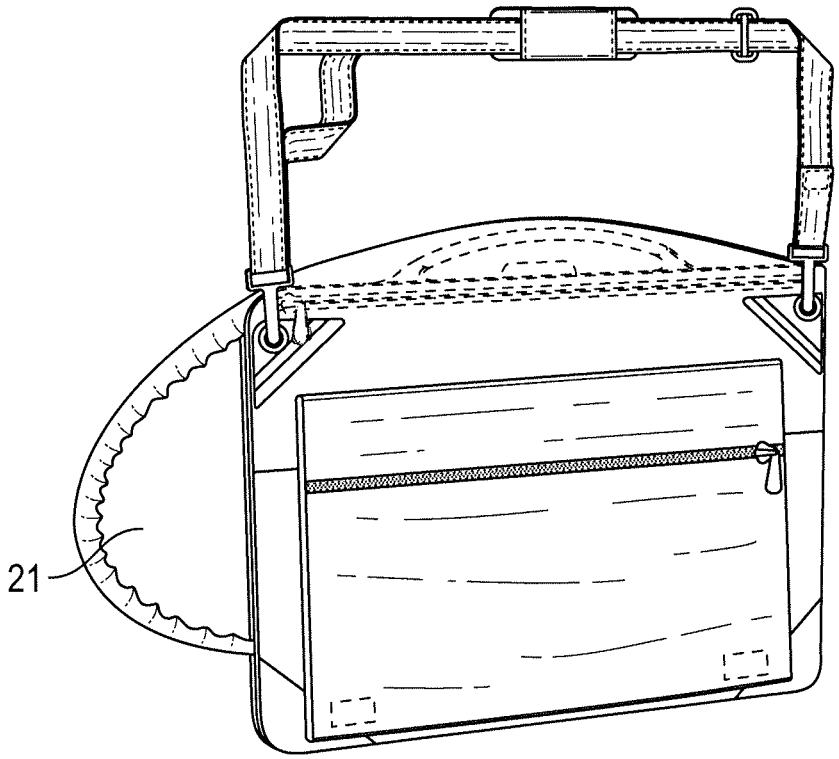
FIG. 6 is a rear view of an embodiment of a cover in combination with a clipboard having a pouch in an extended configuration and a deployable rain screen in a deployed configuration.

FIG. 6 illustrates a view of the second surface 200 of the cover 18 having the deployable rain screen 21 extend out from the first surface 100, illustrating the deployable nature of the rain screen 21.

The term "about" as used herein will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments +/−15%, or possibly as much as +/−20%. Similarly, the term "substantially" will typically mean at least 85% to 99% of the characteristic modified by the term. For example, "substantially all" will mean at least 85%, at least 90%, or at least 95%, etc.

While the present invention has been described in terms of specific embodiments, those skilled in the art will recognize many alternate embodiments intended to fall within the scope of the present invention.

I claim:

1. A clipboard and cover assembly, comprising:

(a) a clipboard having:
  (i) a first side, and
  (ii) a second side opposite the first side;

(b) a cover sized to fit the clipboard snuggly inside a cavity of the cover and to expose the first side of the clipboard, the cover comprising:
  (i) a first surface having an opening formed therein, wherein the opening exposes at least 75% of the first side of the clipboard, the first surface includes flexible material that covers the clipboard at four corners of the first surface of the cover, the first surface further including elastic material that forms a perimeter around the opening that exposes the first side of the clipboard; and
  (ii) a second surface connected opposite to the first surface along an edge around the cover to form the cavity, the second surface covering substantially all of the second side of the clipboard, wherein the second surface includes the flexible material that covers the clipboard at two lower corners of the second surface of the cover and at an upper portion of the second surface, wherein second surface further includes stretchable material between the two lower corners and the upper portion of the second surface, wherein at least 25% of the second surface is formed of the stretchable material,
    (1) wherein the stretchable material is different from the flexible material, and
    (2) wherein the stretchable material is configured to expand and contract when the clipboard is inserted through the opening and into the cavity;

(c) a deployable screen sized to cover substantially all of the opening formed in the first surface of the cover, wherein the deployable screen is attached to the cover at a first attachment point at a top edge of the cover, wherein the deployable screen is configurable in a non-deployed configuration and in a deployed configuration, (i) wherein in the non-deployed configuration, the deployable screen is contained within a closable enclosure located at the first attachment point at the top edge of the cover, and (ii) wherein in the deployed configuration, the deployable screen is deployed outside of the closable enclosure and over the opening formed in the first surface of the cover; and (d) a pouch attached to the second surface of the cover at a second attachment point at the upper portion of flexible material of the second surface of the cover, the pouch being extendable from the second attachment point down over the stretchable material of the second surface of the cover toward the two lower corners, wherein the pouch includes a closing means near the second attachment point, wherein a height and a length of the pouch are smaller than a height and a length of the second surface of the cover.

2. The assembly of claim 1, wherein the second surface further comprises first attachment means for removably attaching the pouch to the flexible material of the second surface.

3. The assembly of claim 1, wherein the elastic material that forms a perimeter around the opening is different from the stretchable material.

4. The assembly of claim 1, wherein the clipboard has dimensions of about 11 inches by about 17 inches.

5. The assembly of claim 1, wherein the clipboard has dimensions of more than about 11 inches by 17 inches.

6. The assembly of claim 1, wherein the clipboard has dimensions of about 8½ inches by 11 inches.

7. The assembly of claim 1, wherein the clipboard has dimensions of less than about 8½ inches by 11 inches.

8. The assembly of claim 1, wherein the opening has a longitudinal length substantially equal to a longitudinal length of the clipboard when the clipboard is disposed inside of the cavity.

9. The assembly of claim 1, wherein the upper portion of flexible material of the second surface of the cover is rectangular shaped.

10. The assembly of claim 1, wherein the stretchable material of the second surface of the cover is trapezoidal shaped.

11. The assembly of claim 1, further comprising a handle attached to an upper portion of the cover.

12. The assembly of claim 1, further comprising a retainer attached to said front of said cover near the first attachment point, wherein the retainer anchors an upper portion of the clipboard to the cover.

13. The assembly of claim 12, wherein the clipboard further comprises a clip located at the upper portion of the clipboard, wherein the retainer fits around a portion of the clip to anchor the clip to the cover.

14. The assembly of claim 1, wherein the deployable screen is made of transparent material.

15. The assembly of claim 1, wherein the deployable screen is made of opaque material.

16. The assembly of claim 1, wherein the closing means comprises a zipper.

17. The assembly of claim 1, wherein the opening is substantially oval shaped.

18. The assembly of claim 1, wherein the clipboard and the cover are rectangular shaped.

19. A method of covering a planar rigid insert, comprising:

(a) providing the planar rigid insert, the planar rigid insert having:

(i) a first side, and (ii) a second side opposite the first side;

(b) providing a cover sized to fit the planar rigid insert snuggly inside a cavity of the cover and to expose the first side of the planar rigid insert, the cover comprising:

(i) a first surface having an opening formed therein, wherein the opening exposes at least 75% of the first side of the planar rigid insert, the first surface includes flexible material that covers the planar rigid insert at four corners of the first surface of the cover, the first surface further including elastic material that forms a perimeter around the opening that exposes the first side of the planar rigid insert; and (ii) a second surface connected opposite to the first surface along an edge around the cover to form the cavity, the second surface covering substantially all of the second side of the planar rigid insert, wherein the second surface includes the flexible material that covers the planar rigid insert at two lower corners of the second surface of the cover and at an upper portion of the second surface, wherein second surface further includes stretchable material between the two lower corners and the upper portion of the second surface, wherein at least 25% of the second surface is formed of the stretchable material, (1) wherein the stretchable material is different from the flexible material, and (2) wherein the stretchable material is configured to expand and contract when the planar rigid insert is inserted through the opening and into the cavity, wherein the flexible material is configured to remain substantially non-expanded and non-contracted when the planar rigid insert is inserted through the opening and into the cavity;

(c) providing a deployable screen sized to cover substantially all of the opening formed in the first surface of the cover, wherein the deployable screen is attached to the cover at a first attachment point at a top edge of the cover, wherein the deployable screen is configurable in a non-deployed configuration and in a deployed configuration, (i) wherein in the non-deployed configuration, the deployable screen is contained within a closable enclosure located at the first attachment point at the top edge of the cover, and (ii) wherein in the deployed configuration, the deployable screen is deployed outside of the closable enclosure and over the opening formed in the first surface of the cover;

(d) providing a pouch attached to the second surface of the cover at a second attachment point at the upper portion of flexible material of the second surface of the cover, the pouch being extendable from the second attachment point down over the stretchable material of the second surface of the cover toward the two lower corners, wherein the pouch includes a closing means near the second attachment point, wherein a height and a length of the pouch are smaller than a height and a length of the second surface of the cover; and (e) fitting the planar rigid insert inside the cavity in the cover exposing at least a portion of the first side of the planar rigid insert and covering the second side of the planar rigid insert.

20. A cover assembly for covering a planar rigid insert having a first side and a second side, comprising:

(a) a cover sized to fit the planar rigid insert snuggly inside a cavity of the cover and to expose the first side of the planar rigid insert, the cover comprising:

(i) a first surface having an opening formed therein, wherein the opening exposes at least 75% of the first side of the planar rigid insert, the first surface includes flexible material that covers the planar rigid insert at four corners of the first surface of the cover, the first surface further including elastic material that forms a perimeter around the opening that exposes the first side of the planar rigid insert; and (ii) a second surface connected opposite to the first surface along an edge around the cover to form the cavity, the second surface covering substantially all of the second side of the planar rigid insert, wherein the second surface includes the flexible material that covers the planar rigid insert at two lower corners of the second surface of the cover and at an upper portion of the second surface, wherein second surface further includes stretchable material between the two lower corners and the upper portion of the second surface, wherein at least 25% of the second surface is formed of the stretchable material, (1) wherein the stretchable material is different from the flexible material, and (2) wherein the stretchable material is configured to expand and contract when the planar rigid insert is inserted through the opening and into the cavity;

(b) a deployable screen sized to cover substantially all of the opening formed in the first surface of the cover, wherein the deployable screen is attached to the cover at a first attachment point at a top edge of the cover, wherein the deployable screen is configurable in a non-deployed configuration and in a deployed configuration, (i) wherein in the non-deployed configuration, the deployable screen is contained within a closable enclosure located at the first attachment point at the top edge of the cover, and (ii) wherein in the deployed configuration, the deployable screen is deployed outside of the closable enclosure and over the opening formed in the first surface of the cover; and (c) a pouch attached to the second surface of the cover at a second attachment point at the upper portion of flexible material of the second surface of the cover, the pouch being extendable from the second attachment point down over the stretchable material of the second surface of the cover toward the two lower corners, wherein the pouch includes a closing means near the second attachment point, wherein a height and a length of the pouch are smaller than a height and a length of the second surface of the cover.

* * * * *